United States Patent [19]

Thurston

[11] 4,084,720

[45] Apr. 18, 1978

[54] BOX CONSTRUCTION

[75] Inventor: Benjamin L. Thurston, Lincoln, R.I.

[73] Assignee: Frost Packaging Company, Pawtucket, R.I.

[21] Appl. No.: 762,463

[22] Filed: Jan. 24, 1977

[51] Int. Cl.[2] ..... B65D 7/34; E04C 2/38

[52] U.S. Cl. ..... 220/76; 52/658; 206/566; 220/334; 403/231; 403/242

[58] Field of Search ..... 220/76, 334; 206/566, 206/45.19; 52/658; 40/152; 24/201 R, 25, 23 EE, 23 W, 23 R, 20 EI, 23 B, 21, 22, 20 R; 403/231, 401, 402, 242, 344, 393, 340, 339

[56] References Cited

U.S. PATENT DOCUMENTS

| | | | |
|---|---|---|---|
| 249,909 | 11/1881 | Donahue | 24/23 EE |
| 1,557,066 | 10/1925 | Krantz | 220/76 |
| 1,855,007 | 4/1932 | Bradley | 24/23 B |
| 2,427,420 | 9/1947 | Rdodes | 220/73 |
| 2,433,446 | 12/1947 | Foster | 403/393 |
| 2,869,694 | 1/1959 | Breckheimer | 52/658 |
| 2,916,181 | 12/1959 | Pfister et al. | 220/76 |
| 3,145,871 | 8/1964 | Cavanagh | 220/334 |
| 3,164,284 | 1/1965 | Bersh et al. | 220/76 |
| 3,305,255 | 2/1967 | Henderson | 52/658 |
| 3,572,538 | 3/1971 | Bergh et al. | 220/334 |

*Primary Examiner*—Stephen P. Garbe
*Assistant Examiner*—Allan N. Shoap
*Attorney, Agent, or Firm*—Salter & Michaelson

[57] ABSTRACT

A box section including a rim portion formed from an elongated strip appropriately shaped and interconnected at opposite ends thereof by means of interengaging tab portions adapted to be bent over one another and received within adjacent depressions of the opposite tab member in such a manner that a variety of decorative and functional coverings, including those of a relatively thick nature, may be applied to such box section without interfering with the construction thereof including its desirable visual and strength characteristics.

10 Claims, 6 Drawing Figures

BOX CONSTRUCTION

BACKGROUND OF THE INVENTION

The present invention relates generally to an improved box construction and more particularly the construction of a box section having particular utility as one of the sections of a two section box.

Boxes of this type are particularly useful for displaying small ornamental articles such as jewelry and the like, and usually include a base section and a cover section, both of which may be of identical construction. Hinge means are normally provided for attaching the two sections to each other. The hinge means may be spring loaded so that the cover will normally be maintained either in a fully open or a fully closed position. It is also known to form box sections of this type from a variety of materials including cardboard, plastic and metal.

Many box sections of the aforementioned type include the use of an elongated material strip appropriately bent into the peripheral shape of the box section and generally designated as "rim stock." Various mechanisms to provide for the terminal interconnection of such rim stock, such as the tongue and groove connections disclosed in U.S. Pat. Nos. 2,521,603 issued Sept. 5, 1950 and 3,107,807 issued Oct. 22, 1963, are commonly utilized. While providing adequate strength, rigidity and structural characteristics to box sections so constructed, interconnections of such type embody close tolerance interfitting parts that require that the thickness of the ultimate rim stock, including any decoration applied thereto, be within a fairly narrow thickness range in order that the such interconnection means function properly. This requirement precludes use of rim stock which may be provided with relatively thick decorative or functional material layers thereover, such as fabric coverings and the like, or in which it is not known what the covering thickness may be. It would accordingly be desirable to provide an alternate construction for interconnecting rim portions of such box sections together in such a manner that rim stock so constructed may be produced in large quantities and distributed to individual boxmakers which may thereafter apply varying thickness covering materials thereto, which application will not interfere with the subsequent interconnection of the rim stock when assembled with such box sections. Examples of other box constructions which may be of interest in the present invention and which may also incorporate rim stock interconnections which to varying degrees are dependent on knowing in advance the ultimate rim stock thickness, including any material layers thereon, include U.S. Pat. No. 3,164,284 issued Jan. 5, 1965 and U.S. Pat. No. 3,340,638 issued Sept. 12, 1967.

SUMMARY OF THE INVENTION

It is accordingly a primary object of the present invention to provide a box section utilizing rim stock to form the sidewalls thereof, which sidewalls are interconnected in such a manner that rim stock of varying thickness may be utilized in such formation without interfering with the assembly or structural rigidity of the box section so formed.

A further object of the present invention is the provision of a box section construction which enables the use of decorative coverings applied to different portions thereof so as to achieve a variety of decorative effects.

A still further object of the present invention is the provision of a box section construction of the immediately aforementioned type wherein the rim portion thereof may be provided with a covering of one color, texture etc. whereas the closure portion, such as a top or bottom wall assembled therewith, may be provided with a covering of a contrasting color, texture etc.

A still further object of the present invention is the provision of a box section including a rim formed of an elongated strip having novel means for interconnecting the opposite ends of such strip and wherein such means is not readily noticeable in the final box construction.

The above outlined objectives are accomplished by the present invention through the use of an elongated strip appropriately bent or formed to assume the desired configuration of the box section, and which includes a central panel defining sidewalls thereof and provided at opposite terminal ends thereof with outwardly projecting tabs adapted to be inwardly bent about each other and received within depressions positioned within said central panel and adjacent such outwardly extending tabs. The bent tabs of each panel terminal portion are respectively received within the depression formed in the other of such terminal panel portions. Each of the depressions are of a depth so as to assure that the tab received therein, regardless of the thickness of the covering material that may be applied thereto, will be disposed either below or generally flush with the remaining surfaces of the sidewall, thus contributing to the inconspicuousness of such interconnections as well as reducing the possibility that edges of the tabs will be exposed, such as might cause scratching or tearing of a person's hand or clothing.

Also, by constructing the box section in the foregoing manner, the proper interconnection of the elongated strip is not dependent upon either the particular surface characteristics or its ultimate thickness, including any covering or decoration applied to the outer surface thereof. With such novel construction, rim stock incorporating such construction may be made up for use by boxmakers in the assembly of many different type box sections, varying from those with no covering applied to the outer surface thereof to those with relatively thick coverings applied thereto, which variables neither interfere with nor detract from the strength or appearance characteristics of the present box construction.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
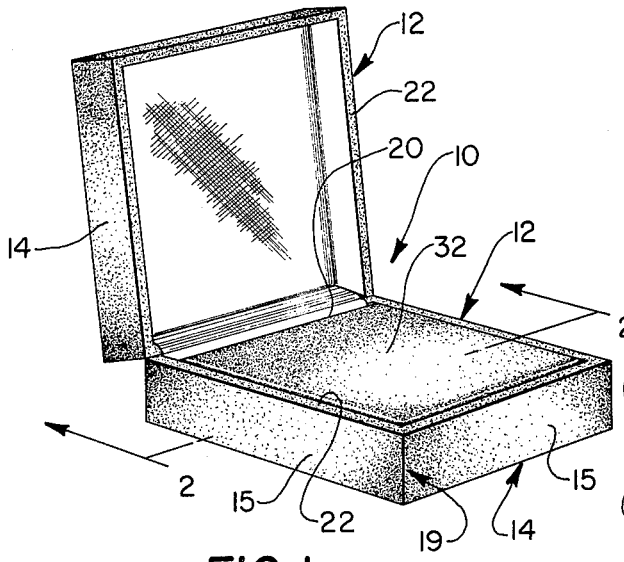
FIG. 1 is a perspective view of a two-piece box incorporating the features of the present invention in one or both of the box sections thereof.
Figure 2:
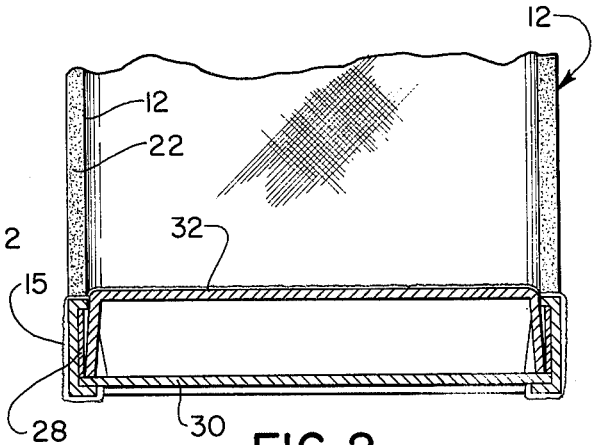
FIG. 2 is a partial elevational view in section taken along the line 2—2 of FIG. 1.

Referring to the drawing, a box 10 including two box sections 12 is shown. Both such box sections 12 may be essentially identical in construction and they are each provided with a peripheral sidewall or rim portion 14 constructed from an elongated integral strip 16 appropriately bent, i.e., at right angles along spaced fold lines 18, so as to form corner portions 19 which in turn serve to divide the box section 12 into a plurality of sidewall sections 15. Naturally the number of such sidewall sections 15 and the angle or angles at which the elongated strip is appropriately bent is dependent on the ultimate shape desired for the box section, three or more being necessary to formulate an enclosed container-like box section and four being shown in the drawings so as to form a rectangular rim.

As above indicated, one of these box sections 12 may then be joined to a similar box section as along a hinge line 20 which may be provided with spring actuation (not shown) which serves to maintain the box 10 either in a fully open position, as shown in FIG. 1, or in a fully closed position. In such fully closed position the box sections 12 are disposed in face-to-face relationship and for this purpose the strip 16 is provided with at least one, and preferably two, flanges 22 which extend from opposite edges of the main centrally disposed panel 24 of the elongated strip 16, whereby the latter assumes a channel-like configuration. Such flanges 22 are further appropriately notched as at 26 so that when the strip is inwardly bent as previously explained to form the corner portions, the side edges of the notches 26 will be disposed in abutting relationship to each other. It may thus be apparent that the flange 22 disposed innermost serves to engage a similarly disposed flange on a mating box section 12 and thus prevents any chance of the box sections 12 telescoping within one another when the box snaps closed.

The presence of the flanges 22 also enables a strip member 28 to be placed in supporting engagement with the inner surface of the main panel 24, as well as providing a ledge for receiving a closure wall 30, comprising either a bottom or top, dependent on how that particular box section 12 is disposed, it being noted that the wall 30 is sandwiched between the edge of strip 28 and the adjacent flange 22. The member 28 and the box section closure 30 may be formed of a variety of materials, including plastic and paperboard, whereas the elongated strip 16 forming the rim portion 14 is generally formed of an integral strip of deformable metal, generally referred to as "rim stock". Also, that box section 12 which is utilized as the bottom portion of the container or box 10 is generally further provided with an article support or insert 32 appropriately formed so as to be retained within such box section and generally adapted to receive jewelry type articles for the display thereof within the box 10. Notwithstanding the specific use above indicated, the box or box sections in the present invention are not so limited, but have broader utility, as for the containment of any goods.

Figure 3:
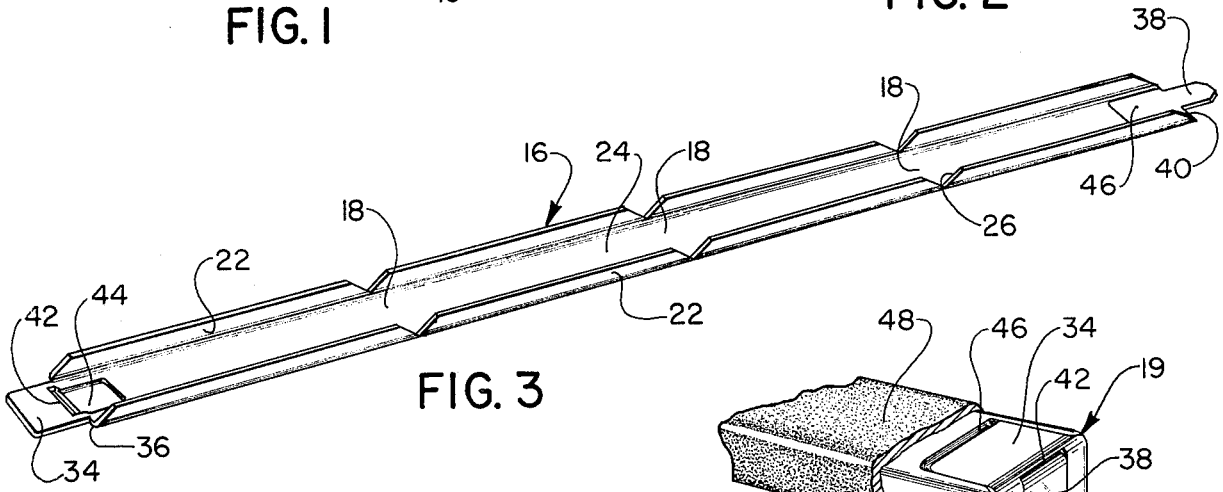
FIG. 3 is a perspective view of the elongated rim stock strip utilized in the present invention.

Turning now more specifically to the construction of the elongated strip 16, as by reference to FIG. 3 of the drawing, it may be seen that the terminal portions of the main panel 24 thereof are each provided with a tab. Thus, a first tab 34 extends generally across the entire or a major portion of a first terminal end 36 while a second narrower tab 38 extends laterally across a reduced extent of a second terminal portion or edge 40. The first tab 34 is further provided with an opening or slot 42 of a thickness and lateral extent large enough to receive the second tab 38 therein.

Figure 5:
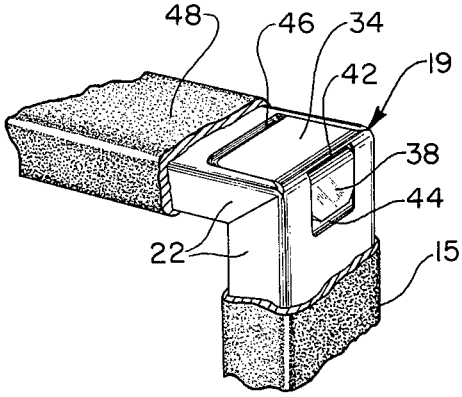
FIG. 5 is an assembled view of the corner construction depicted in FIG. 4, also with portions of the covering material removed for clarity.
Figure 4:
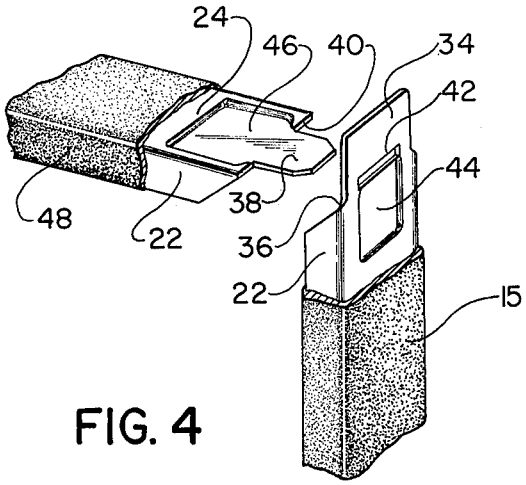
FIG. 4 is a partial perspective view, on an enlarged scale, with portions of the covering material provided thereon removed for purposes of clarity.
Figure 6:
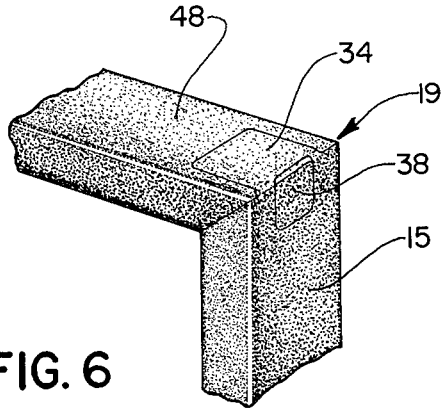
FIG. 6 is a partial perspective view of the same corner section as depicted in FIG. 5 with the covering material in place thereon.

Additionally, each terminal portion of the panel 24 is provided with a depression adapted to receive one of the tabs 34, 38; there being a first depressed area or dap 44 immediately adjacent the opening 42 and a second depressed area or dap 46 immediately adjacent the second tab 38. In practice, the individual strips 16 would be formed from flat stock to produce the configuration shown in FIG. 3 as by known cutting or punching techniques and thereafter appropriately bent so as to form the spaced flanges 22. Thereafter the strip 16 is bent along lines 18 to form the overall peripheral configuration of the box section 12 and the individual panel or sidewall portions 15 thereof. Then the strip 28 and the end closure 30 may be assembled, after which the tab 38 is pushed through the slot 42 and downwardly bent into the depression 44. Similarly the first tab 34 is then downwardly bent into the depression 46 to complete the corner construction and so as to produce a rigid assembly. When assembled, as best observed from simultaneous reference to FIGS. 4 through 6 of the drawing, it is also clear that the terminal edges 36, 40 are in abutting or closely adjacent disposition to each other, i.e., edge 40 abuts or juxtaposes those portions of the tab 34 positioned on either side of the slot 42. The resultant box section construction provides corners 19 exhibiting greater rigidity than those otherwise formed completely of cardboard and at a lower cost than boxes formed completely of metal. Actually, the box 10, because of the channel-like configuration of the strip 16, possesses a high degree of strength, and in practice has been found to be substantially as strong as an all metal box.

The most important feature, however, of the present invention is that the above-described corner box section construction is completed in such a manner that its operation is not dependent upon the thickness of sidewalls 15. Also, the rim parts which contact each other so as to bring about such interconnection do not need to be of a particular surface characteristic, i.e., in many prior art constructions, as previously mentioned, it was necessary that the thickness be predetermined and that the interengaging parts be unyielding so as to provide interlock effects, as with detents and the like. The present construction enables the use of a single strip, such as strip 16 to be utilized in the formation of a wide variety of box sections 12, including those provided with a relatively thick covering 48 on the other surface thereof. Previously, such covering 48, when applied to the outer surface of rim stock having outwardly extending tabs adapted for receipt in grooves and the like, would cause interference therewith, or would otherwise adversely affect the critical spacing necessary for the locking parts to effectively function, either necessitating the masking of those portions or the custom design of the locking parts to accommodate the selected covering thickness, both alternatives being undesirable from a cost and manufacturing standpoint. The present invention obviates these prior art drawbacks through the provision of the above disclosed cooperating tabs adapted for receipt in the depressions provided for that purpose, since no critical tolerances exist for operative assembly of the locking parts. Furthermore, the tabs, once interlocked with each other, assure retention of the box section 12 in the appropriate shape and also contribute to an enhanced rigidity at such terminal corner by reason of the coaction of each of the tabs against its underlying sidewall section. The depth of each of the depressions 44, 46 is such to fully accommodate a reasonable range of tab thicknesses including that of the covering material 48, which may range from relatively thin surface coatings, including paint and plastic layers applied by conventional techniques, to flocking and the adhesive application of a separate fabric material including relatively high pile materials.

Also, inasmuch as the covering 48 is generally applied to the entire outer surface of the elongated strip 16, the sidewalls 14 and the tabs 34, 38 and the depressions 44, 46 accordingly are of the same color, hence the corner construction 19 of the present invention tends to be visually unobtrusive. The previously discussed generally flush positioning of the tabs 34, 38 within the depressions 46, 44 respectively further contributes to this effect, and additionally assures that the tabs do not outwardly extend beyond the sidewalls 14 and thus eliminate the possibility of such contacting the person or clothing of those utilizing the box sections 12.

Additionally, the box section closure wall 30 may be similarly provided with a covering of material 48 similar to that utilized to cover the sidewalls 14 thereof, but of a different or contrasting color, texture etc., if desired, thus enabling interesting two-tone visual effects to be achieved. It is difficult to achieve such visual effects with prior art constructions, due to the limited coverings that could be applied to the sidewalls without adversely affecting the locking connection at the terminal ends of the rim stock.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A multi-corner box section comprising a rim portion formed from an elongated strip appropriately shaped to assume the desired configuration of said box section and having a central panel defining sidewalls thereof, opposite first and second terminal portions of said strip disposed adjacent to each other to form one of said corners, said first and second strip ends respectively having a first tab and a second tab outwardly extending from said central panel portions thereof, the panel portions of said first and second terminal end portions adjacent the tabs thereof including first and second longitudinally extending open top depressions respectively, said depressions each having an end portion thereof being disposed contiguous to each other and each such depression disposed entirely on a different adjacent corner surface, said first tab further including an opening adjacent that end of said first depression which is contiguous to said second depression, said second tab received within said opening and both of said tabs inwardly bent about their respective terminal ends into engagement with an adjacent sidewall, said first tab substantially entirely received within said second depression and said second tab substantially entirely received within said first depression.

2. The structure of claim 1, said strip including a relatively thick covering extending over the entire outer surface thereof including said tabs.

3. The structure of claim 2, said depressions of a depth generally equal to the combined thickness of said panel and said covering so that said tabs, as disposed within said depressions, are generally flush with the remaining sidewall portions of said rim.

4. The structure of claim 2, said box section including a closure disposed within said rim portion, said closure similarly including a relatively thick covering extending over the outer surface thereof, said closure covering being of a color or texture distinguishable from that of said rim.

5. The structure of claim 1, said opening comprising a laterally extending slot within the extent of said first tab, said second tab centrally disposed and of a lateral extent less than said second terminal end so as to form shoulder extensions on either side thereof, said extensions abutting said first tab.

6. The structure of claim 1, said strip including a pair of flanges extending from opposite edges of said central panel portion thereof, one of said flanges adapted to receive an end closure for said box section and the other of said flanges adapted to coact with a similar flange on a mating box section to prevent telescoping of said box sections.

7. The structure of claim 6, said closure similarly including a relatively thick covering extending over the outer surface thereof, said closure covering being a color different than that of said rim covering.

8. The structure of claim 6, said rim partially enclosing a stiffening member of similar configuration as said strip panel portion disposed in contact with inner wall portions of said central panel, said member retained therein by mutual contact at opposed edges thereof with said flanges.

9. A rim stock construction adapted to form the rim portion of a multi-corner box section comprising an elongated generally thin material strip having a central panel and a pair of generally opposed parallely disposed flanges extending from opposite longitudinal edges of said central panel along the entire extent thereof, said panel terminating in first and second end portions, said first and second end portions respectively having a first tab and a second tab outwardly extending therefrom, said first tab including a transversely disposed slot of an extent at least equal to that of said second tab, and said terminal panel end portions including first and second longitudinally extending depressions, respectively, at least equal in extent to that of said second and first tabs respectively, said depressions adapted to be longitudinally contiguously disposed to one another when said second tab is received within said slot and both of said tabs inwardly bent about their respective terminal ends and substantially entirely received within said depressions respectively underlying said tabs.

10. The structure of claim 9, said strip including a relatively thick covering extending over the entire outer surface thereof, including said tabs.

* * * * *